US005343727A

United States Patent [19]

Osaka

[11] Patent Number: 5,343,727

[45] Date of Patent: Sep. 6, 1994

[54] PANEL BENDER

[75] Inventor: Hisao Osaka, Ishikawa, Japan

[73] Assignee: Kabushiki Kaisha Komatsu Seisakusho, Japan

[21] Appl. No.: 923,805

[22] PCT Filed: Mar. 7, 1991

[86] PCT No.: PCT/JP91/00311

§ 371 Date: Aug. 31, 1992

§ 102(e) Date: Aug. 31, 1992

[87] PCT Pub. No.: WO91/13705

PCT Pub. Date: Sep. 19, 1991

[30] Foreign Application Priority Data

Mar. 7, 1990 [JP] Japan ..... 2-22116

[51] Int. Cl.[5] ..... B21D 5/04; B21D 43/12

[52] U.S. Cl. ..... 72/306; 72/319; 72/323; 72/422

[58] Field of Search ..... 72/323, 319, 320, 306, 72/447, 422

[56] References Cited

U.S. PATENT DOCUMENTS 4,804,077 2/1989 John ..... 72/306

FOREIGN PATENT DOCUMENTS

| | | | |
|---|---|---|---|
| 2602160 | 2/1988 | France | 72/306 |
| 52-9551 | 3/1977 | Japan . | |
| 60-36918 | 3/1985 | Japan . | |
| 123615 | 4/1985 | Japan . | |
| 60-146538 | 9/1985 | Japan . | |
| 61-152326 | 9/1986 | Japan . | |
| 573273 | 3/1976 | Switzerland | 72/306 |

*Primary Examiner*—Daniel C. Crane

*Attorney, Agent, or Firm*—Ronald P. Kananen

[57] ABSTRACT

A panel bender which can remarkably improve productivity in a bending process, and can feed in and out works having different widths with a single conveyer without causing interference between a main body and the conveyer has construction in which a plurality of main bodies (1) are provided at opposite positions across a conveyer (16) for feeding the work (A) to a working position within the panel bender, each of the main bodies being movable in a back and forth direction with respect to the other by a back and force feeding device (13). The conveyer (16) disposed between the main bodies is adapted to expand and contract in the width direction in cooperation with back and forth movement of the main bodies.

11 Claims, 13 Drawing Sheets

PANEL BENDER

FIELD OF THE INVENTION

The present invention relates a panel bender for fixing a work to be bent at a working position and performing a process on the work by shifting a main body of a bender to the working position.

BACKGROUND ART

Conventionally, a panel bender for performing a bending process for a plate form work has been known, as disclosed in Japanese Examined Patent Publication (Kokoku) No. 61-103625.

The above-mentioned panel bender is designed to feed a work, which is transported in front of a main body of a bender, toward the main body of the bender by means of a pusher mechanism. The main body of the bender is fixed on a floor.

In the conventional panel bender, a bending process is performed for one portion at one process step. Therefore, when the bending process is performed for a plurality of portions of one work, it becomes necessary to position the work for each completion of the bending process. This results in a long period required for bending a single piece of the work and thus in low productivity.

SUMMARY OF THE INVENTION

The present invention has been made in view of the foregoing situation. Therefore, it is an object to provide a panel bender which can remarkably improve productivity in a bending process and can perform feeding in and out of works to be bent and having different widths, with a single conveyer.

In order to accomplish the above-mentioned object, there is provided, according to the present invention, a panel bender for bending a work held between a depression die vertically moved by means of a plurality of work holding cylinders fixed in alignment with regular intervals on the upper portion of a main body of the device, and a receiving die provided at the lower portion of the main body and fixed on a bed of the main body, with a downward bending die and an upward bending die provided on a pivotal arm pivoted about a support shaft by a vertical bending driving device, which is characterized in that a plurality of main bodies are provided at opposite positions across a conveyer for feeding the work to a working position within the panel bender, each of the main bodies being movable in a back and forth direction with respect to the other by a back and force feeding device, and the conveyer disposed between the main bodies being adapted to expand and contract in the width direction in cooperation with bask and forth movement of the main bodies.

The above-mentioned and other objects, aspects and advantages of the present invention will become clear to those skilled in the art from the following illustration and discussion associated with the accompanying drawings illustrating the preferred embodiment consistent with the principle of the present invention.

DETAILED DESCRIPTION OF THE PREFERRED EMBODIMENT

Figure 1:
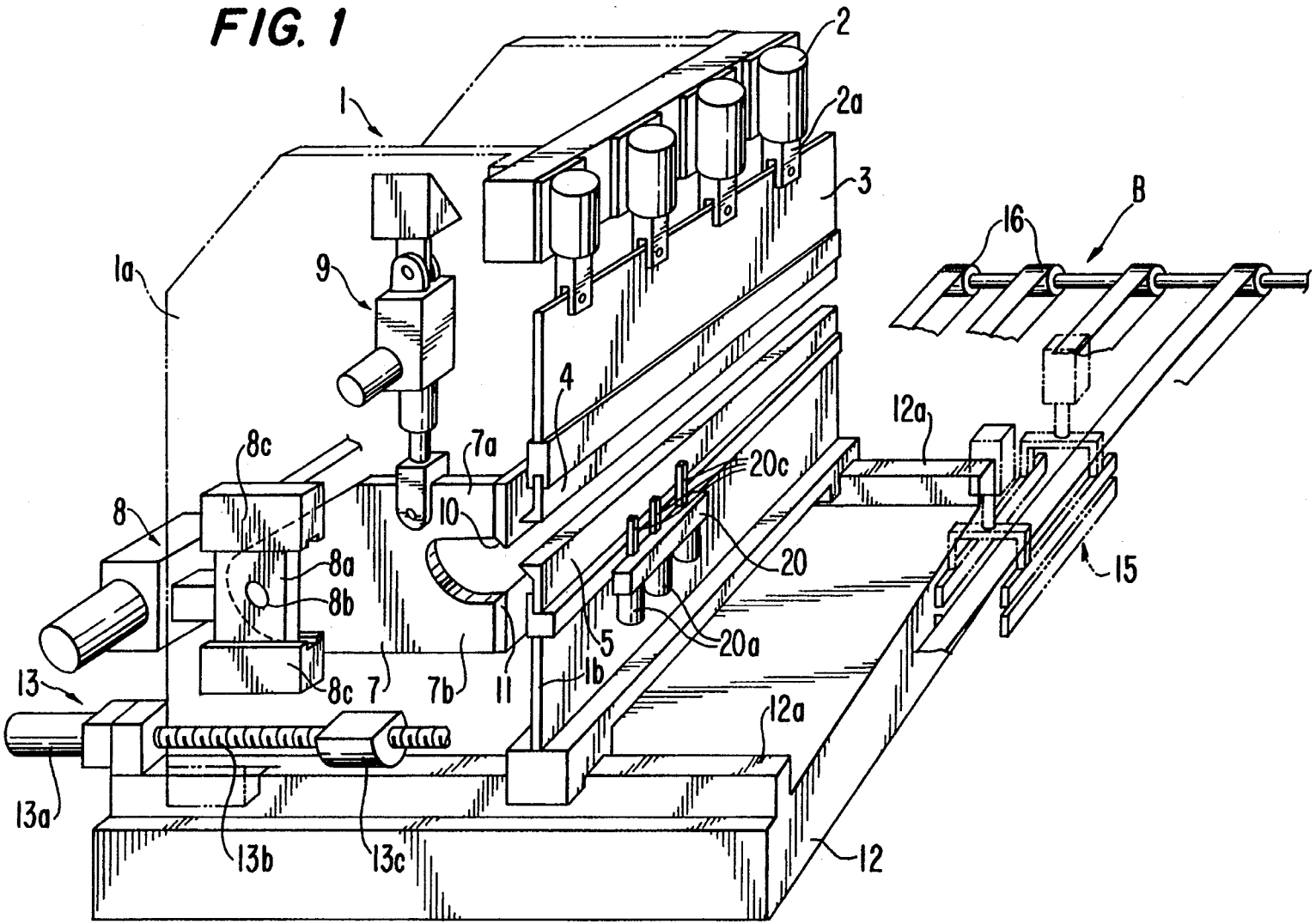
FIG. 1 is a fragmentary perspective view showing an overall construction of one embodiment of a main body.

One embodiment of the present invention will be discussed in detail with reference to the accompanying drawings.

In the drawings, the reference numeral 1 denotes a main body of a panel bender, in which a plurality of work holding cylinders 2 are mounted on a C frame 1*a* with equal intervals in the longitudinal direction of a bed 1*b*. A vertically movable member 3 is mounted on the tip ends of piston rods 2*a* downwardly extending from the work holding cylinders 2. A depression die 4 is attached below the vertically movable member 3. Beneath the depression die 4, a receiving die 5 is provided, which receiving die is fixed to the bed 1*b* of the main body of the panel bender. The depression die 4 and the receiving die 5 grip therebetween a work A (see FIG. 25) to be bent at a bending position.

On the other hand, the reference numeral 6 denotes a work holding releasing device which restricts upward movement of the vertically movable member 3 to facilitate re-positioning of the work A. The reference numeral 7 denotes a pivotal arm having base ends supported on a slider 8*a* of a gap adjusting device 8 via support shaft 8*b*. The reference numeral 9 denotes a vertical bending drive device for vertically moving the tip end side of the pivotal arm 7 about the support shaft 8*b*.

Figure 2:
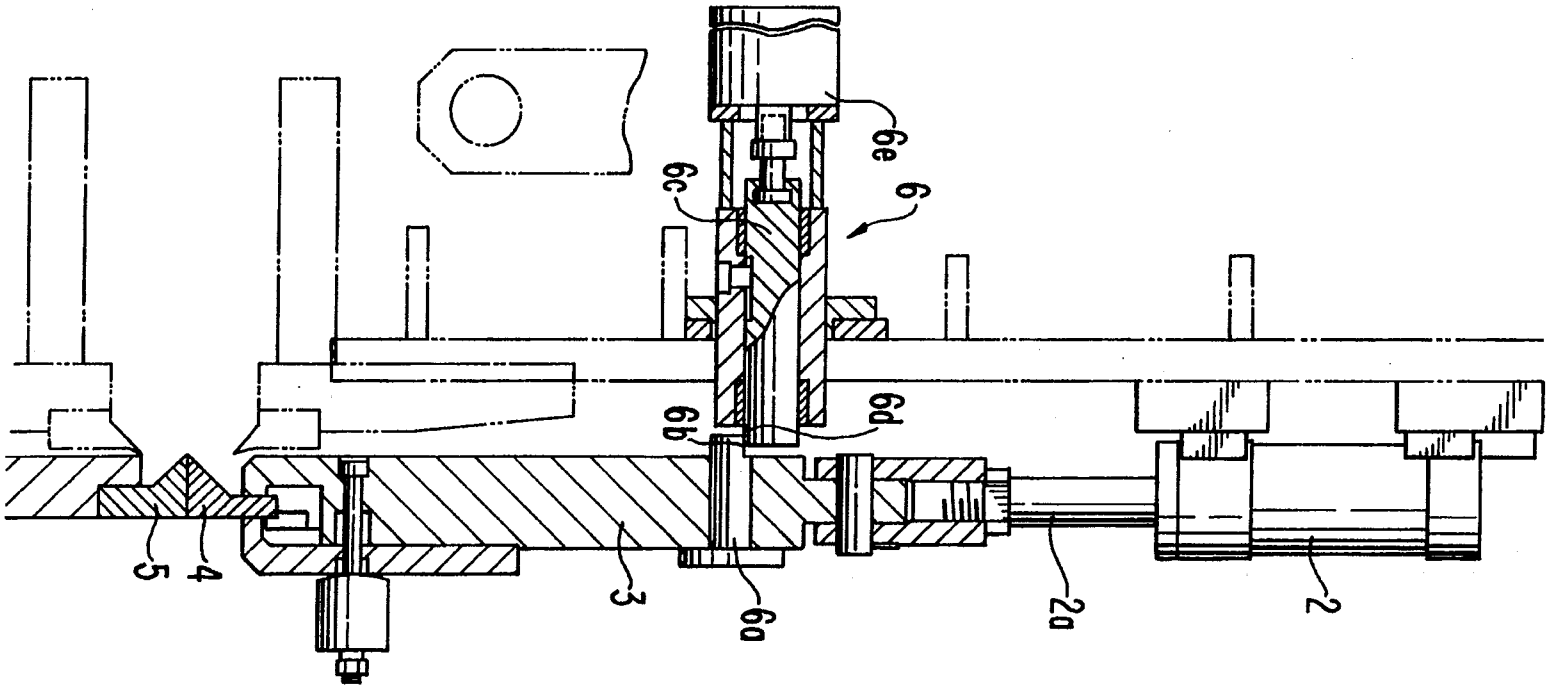
FIG. 2 is a section showing the construction around a work holding and releasing device.

The work holding releasing device 6 and a plurality of engaging pins 6*a* are provided above the vertically movable member 3, as best seen in FIG. 2. Each engaging pin 6*a* is projected rearwardly and has a tapered surface 6*b*. The tapered surface 6*b* is engageable with a stopper pin 6*c* provided at a rear position of the engaging pin 6*a*.

The above-mentioned stopper pin 6*c* is supported for free movement in the back and forth direction of the main body, and is formed with a tapered surface 6*d* contacting with the tapered surface 6*b* of the above-mentioned engaging pin 6*a*, at the tip end thereof. An actuation cylinder 6*e* is connected to the rear end of the stopper pin 6*c* so that the stopper pin 76*c* is shifted toward and away from the engaging pin 6*a*.

Figure 3:
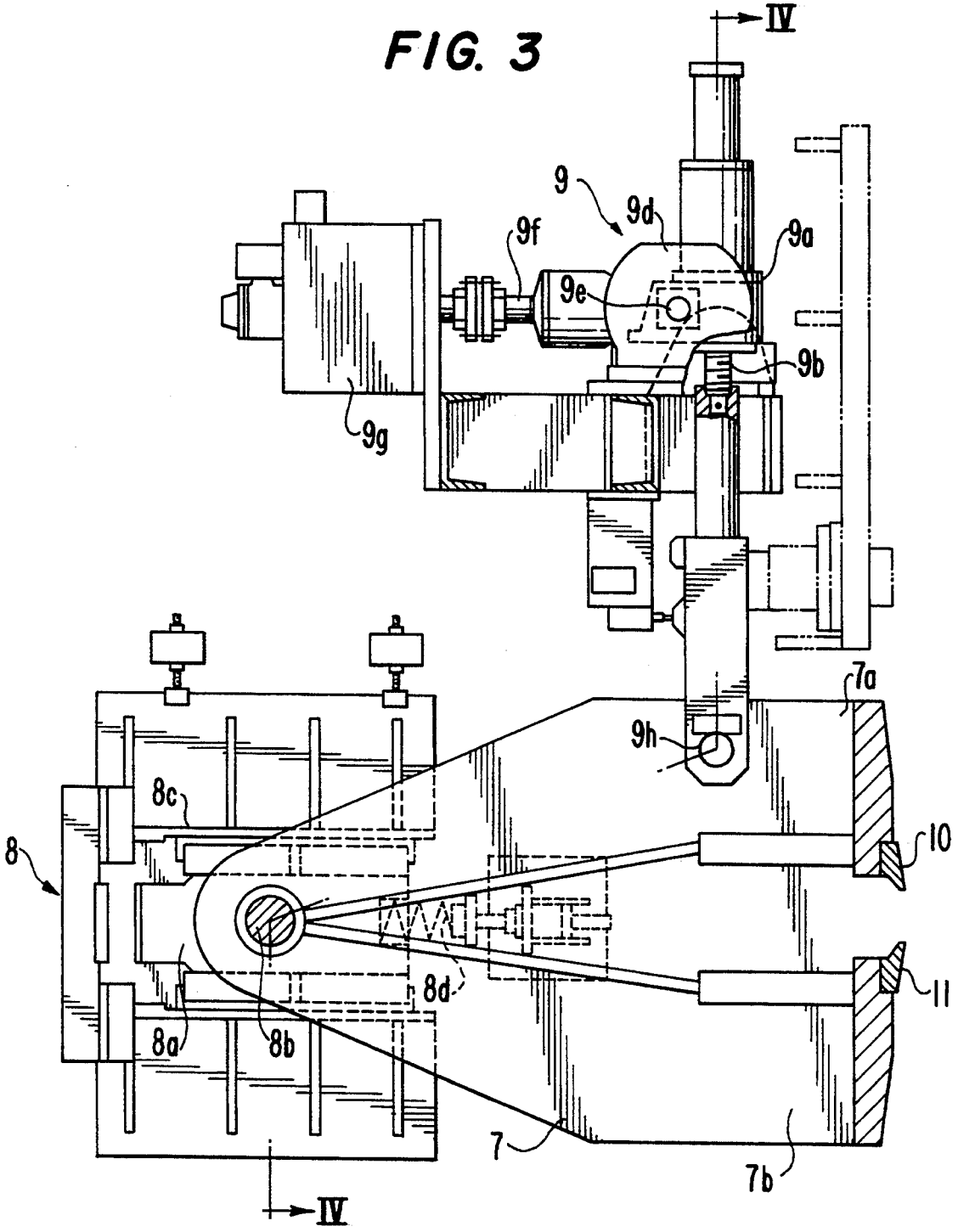
FIG. 3 is a partially cut-out section showing the construction around a vertical being drive device.
Figure 4:
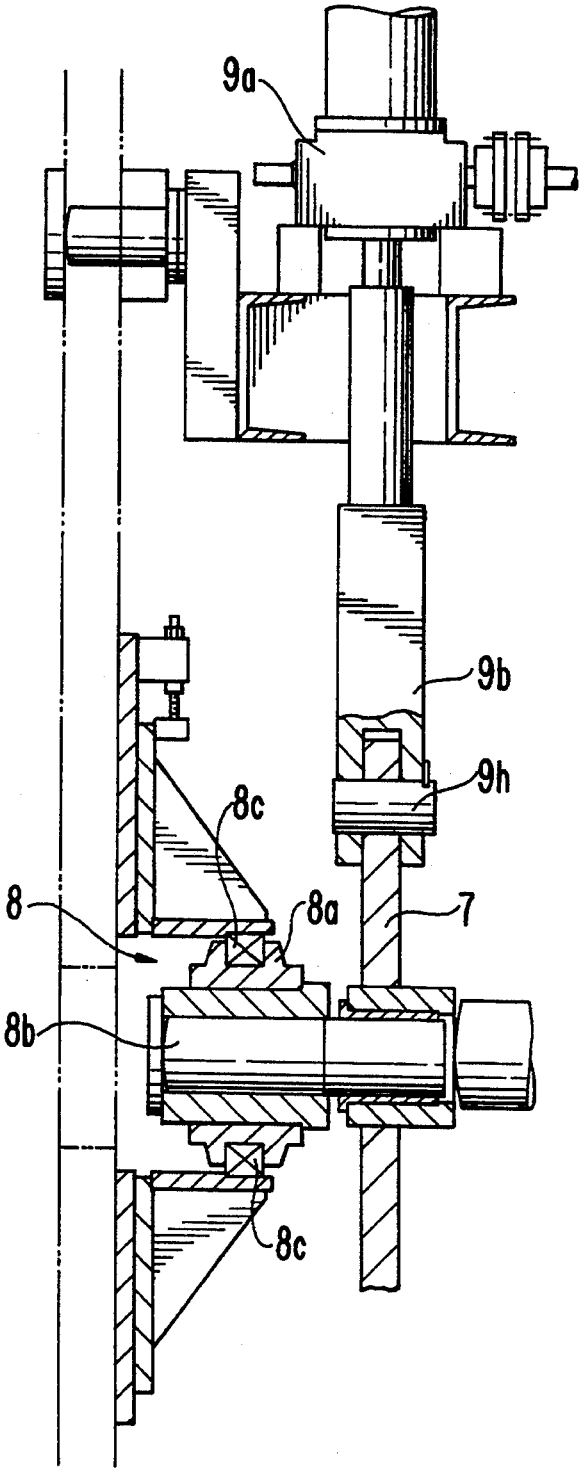
FIG. 4 is a section taken along line IV—IV of FIG. 3.

On the other hand, the tip end side of the above-mentioned pivotal arm 7 is bifurcated in a vertical direction (FIG. 3). An upper branched leg 7*a* of the pivotal arm carries a downwardly bending die 10 which is so constructed as to have a downwardly tapered tip end. A lower branched leg 7b carries an upwardly bending die 11 which has an upwardly tapered tip end. The work A is bent at a desired angle between the downwardly bending die 10 or upwardly being die 11 and the above-mentioned depression die 4 and the receiving die 5.

The above-mentioned gap adjusting device 8 has a slider 8a which is movable in the back and forth direction as guided by a guide rail 8c extending in the back and forth direction of the main body, and is provided at both sides of the main body 1. With the support shafts 8b extending from these sliders 8a, the base ends of the pivotal arms 7 are supported as shown in FIG. 3.

Figure 5:
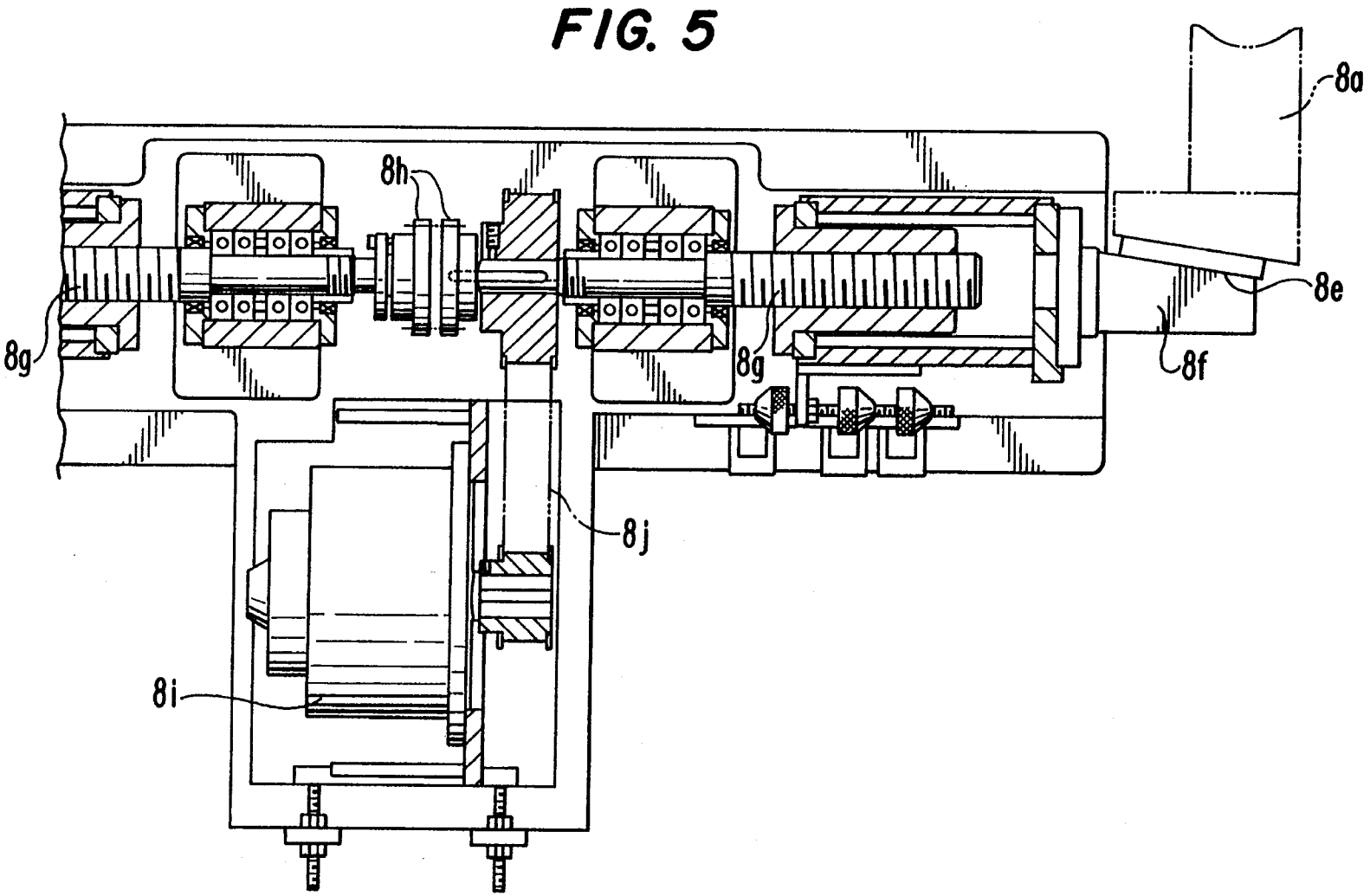
FIG. 5 is a cross section showing a gap adjusting device.

Each of the above-mentioned sliders 8a is biased rearwardly by means of a biasing means 8d provided at the front side. An inclined surface 8e is formed at the rear portion of each slider 8a, which inclined surface 8e is adapted to contact with a wedge member 8f (FIG. 5).

Each wedge member 8f is supported for free movement in the lateral direction relative to the main body 1. One end of a ball screw shaft 8g with a reverse thread is threadingly engaged to the wedge member 8f.

The other end of each ball screw shaft 8g is connected to the other ball screw shaft via a joint 8h. On the other hand, the ball screw shaft 8g is cooperated with a drive motor 8i through an endless belt 8j so that the ball screw shafts 8g are driven simultaneously by the drive motor 8i to move each of the wedge members 8f toward and away from each other.

Figure 6:
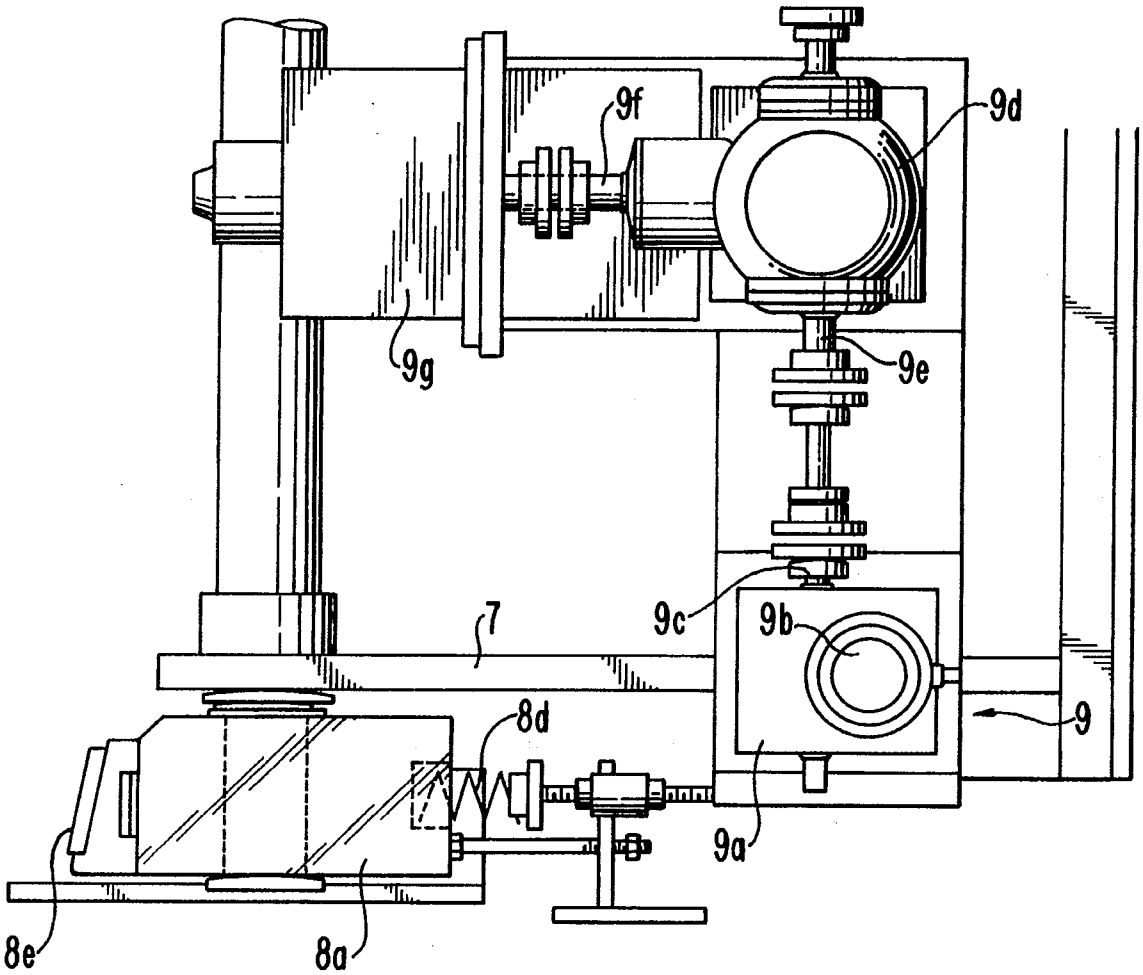
FIG. 6 is a plan view of the vertical bending drive device.

On the other hand, as seen in FIG. 6, the above-mentioned vertical bending driving device 9 includes two sets of screw jacks 9a on the upper portion of the main body 1 in a laterally spaced relationship. The upper portion of the pivotal arm 7 is pivotally connected to the lower ends of drive shafts 9b extending downwardly from the screw jacks 9a.

The input shafts 9c of the screw jacks 9a are respectively connected to a reduction gear unit 9d provided between the screw jacks 9a. The input shaft 9f of the reduction gear unit 9d is connected to a vertical driving motor 9g. BY this vertical driving motor 9g, the tip end of the pivotal arm 7 is moved vertically about the support shaft 8b via the screw jack 9a.

On the other hand, the main body 1 is mounted on guide rails 12a projected on the upper surface of a slide base 12 for sliding movement along the guide rails 12a. A back and forth driving motor 13a of a back and forth driving device 13 is provided at the rear portion of the slide base 12 (FIG. 7).

The back and forth drive motor 13a is connected to a feed screw shaft 13b so that it may drive this feed screw shaft 13b. The feed screw shaft 13b threadingly engages with a nut member 13c provided at the bottom of the main body 1 to drive the main body 1 in a back and forth direction by the rotation of the feed screw shaft 13b.

At the front side of the main body 1, a conveyer 16 for feeding in the work A to be bent and a work clamping device 15 are respectively provided. Also, a back gauge 17 is provided in the main body 1 to contact with the end of the work A and determine the bending position.

Figure 7:
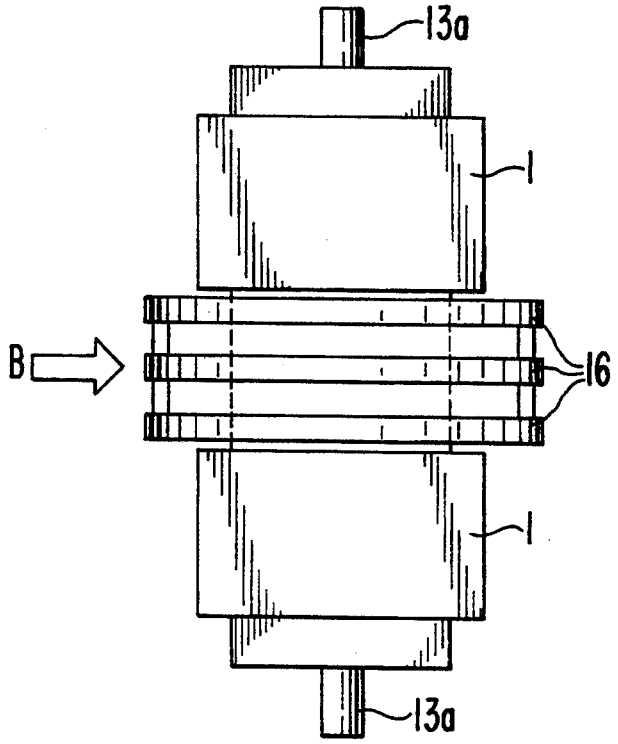
FIGS. 7 and 8 are a plan view and a front elevation showing an arrangement of a conveyer.
Figure 10:
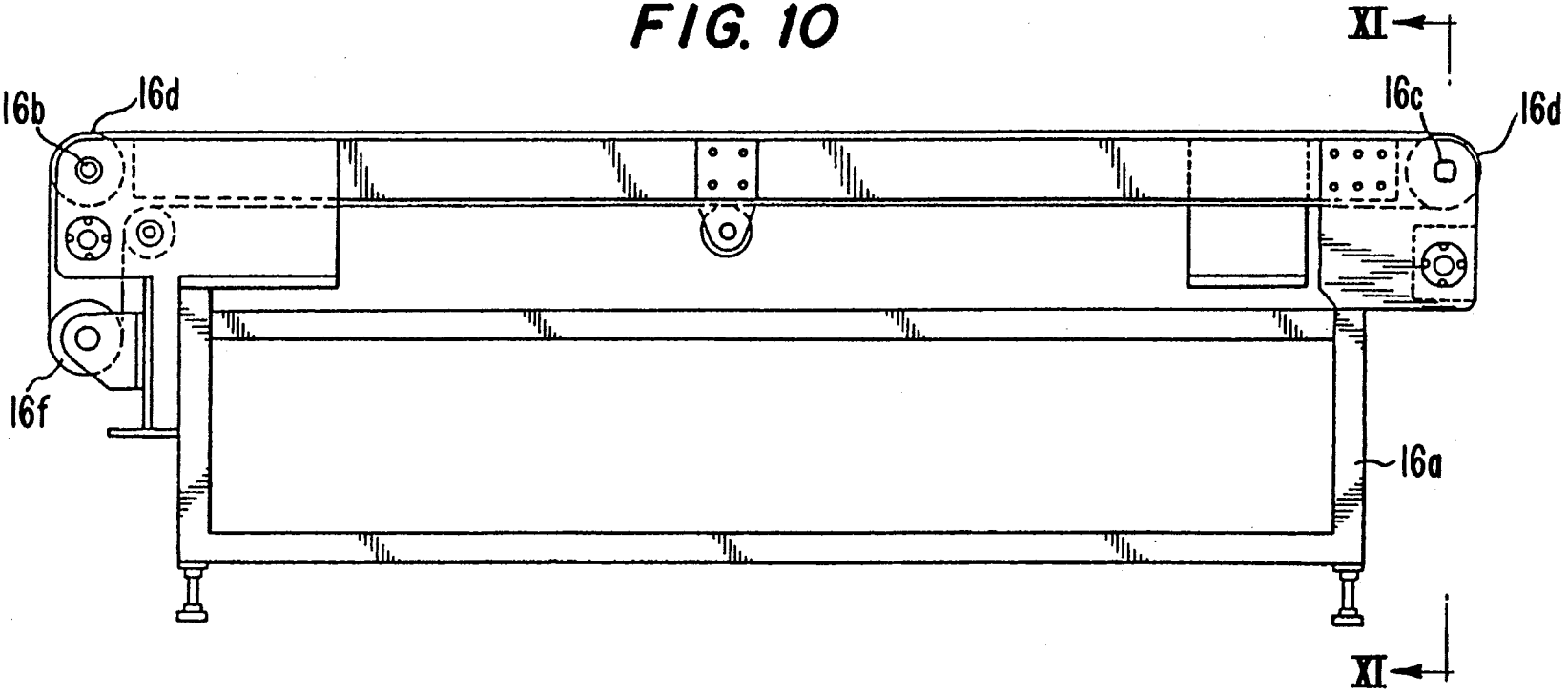
Figure 11:
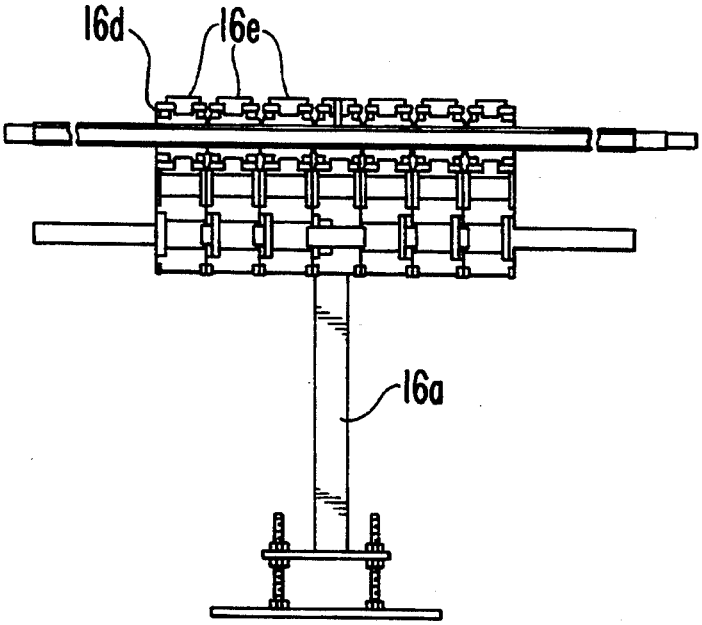
FIG. 11 is a section taken along line X—X of FIG. 10.

As shown in FIG. 7, the above-mentioned conveyer 16 is arranged to a position between two main bodies 1 which are provided in opposition to each other. The conveyer 16 has a base frame 16a fixed on the slide base 12 (see FIG. 10).

The base frame 16a has two rotary shafts 16b and 16c provided on upper portions at both ends, which rotary shafts 16b and 16c extend in a parallel relationship to each other. A plurality of pulleys 16d are mounted on these rotary shafts 16b and 16c.

The pulleys 16d positioned at the central portions of the rotary shafts 16b and 16c are rigidly secured to the rotary shafts 16b and 16c. Between these pulleys 16d, a plurality of endless transporting belts 16e are extended.

The transporting belts 16e are also wrapped on a driving pulleys 16f which are driven by a not shown driving motor so as to be driven by the driving pulleys 16f. Frames 16g provided at both sides of the conveyer 16 are fixed to the main body 1 so that the transporting belts 16e may move in the moving direction of the main body 1 when the main body 1 is moved to vary the distance between the transporting belts 16e.

Figure 9:
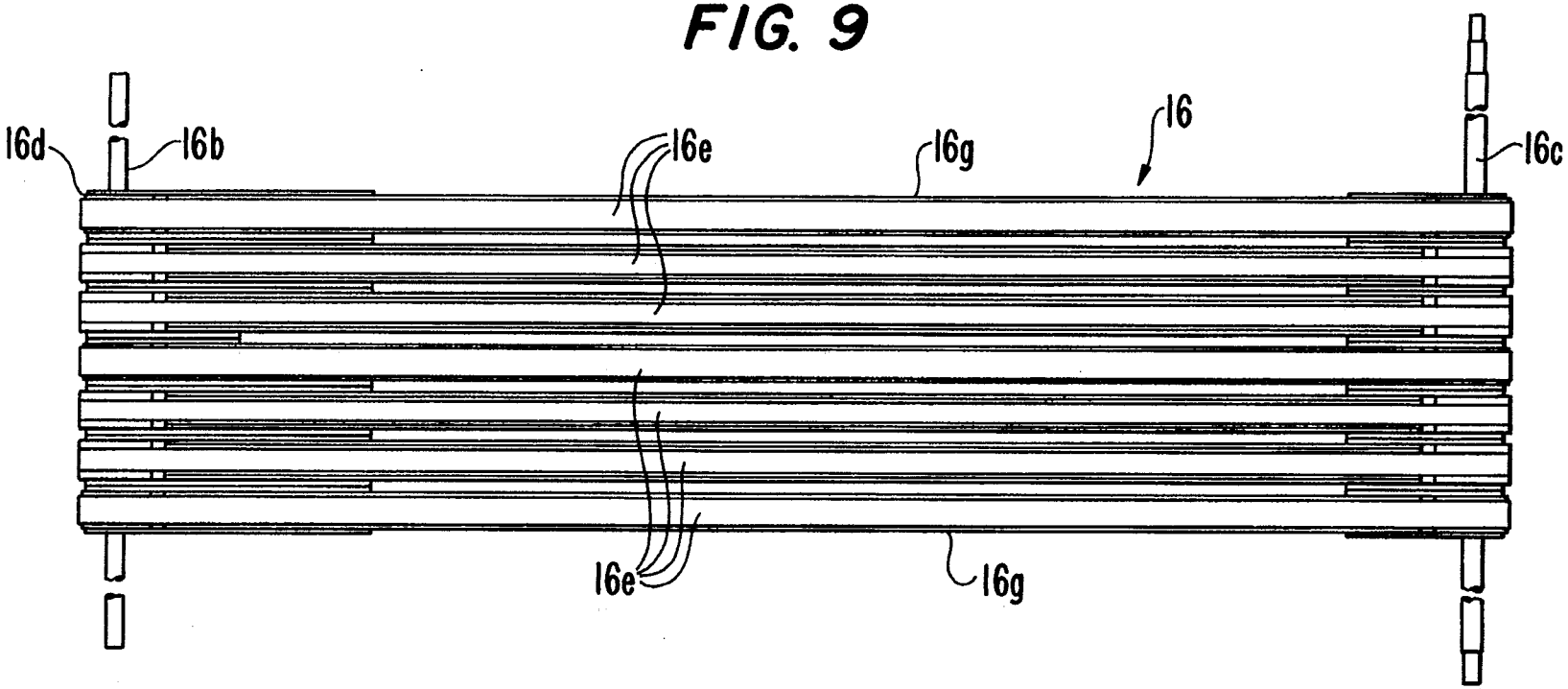
FIGS. 9 and 10 are a plan view and a side elevation showing the conveyer.

It should be noted that FIG. 9 shows the position where the distances between the transporting belts 16e are reduced to be minimum.

Figure 12:
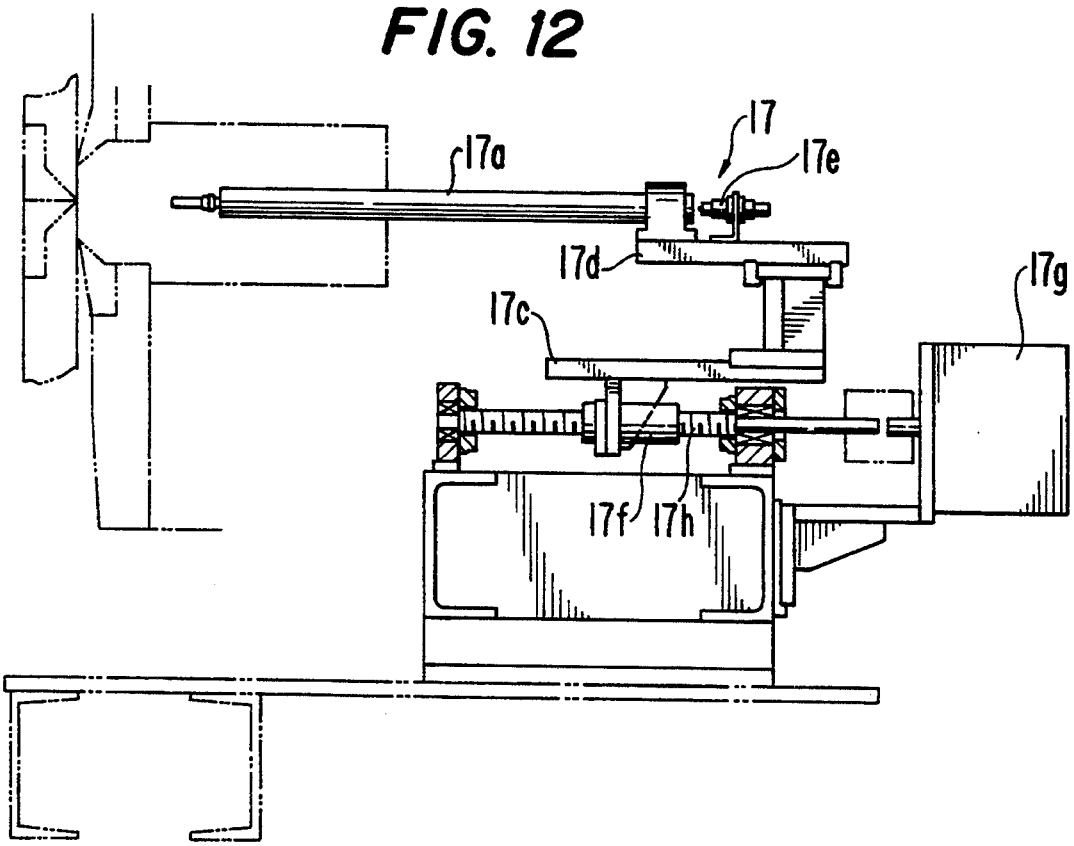
FIGS. 12 and 13 are a partially sectioned side elevation and an enlarged section showing a back gauge device.
Figure 13:
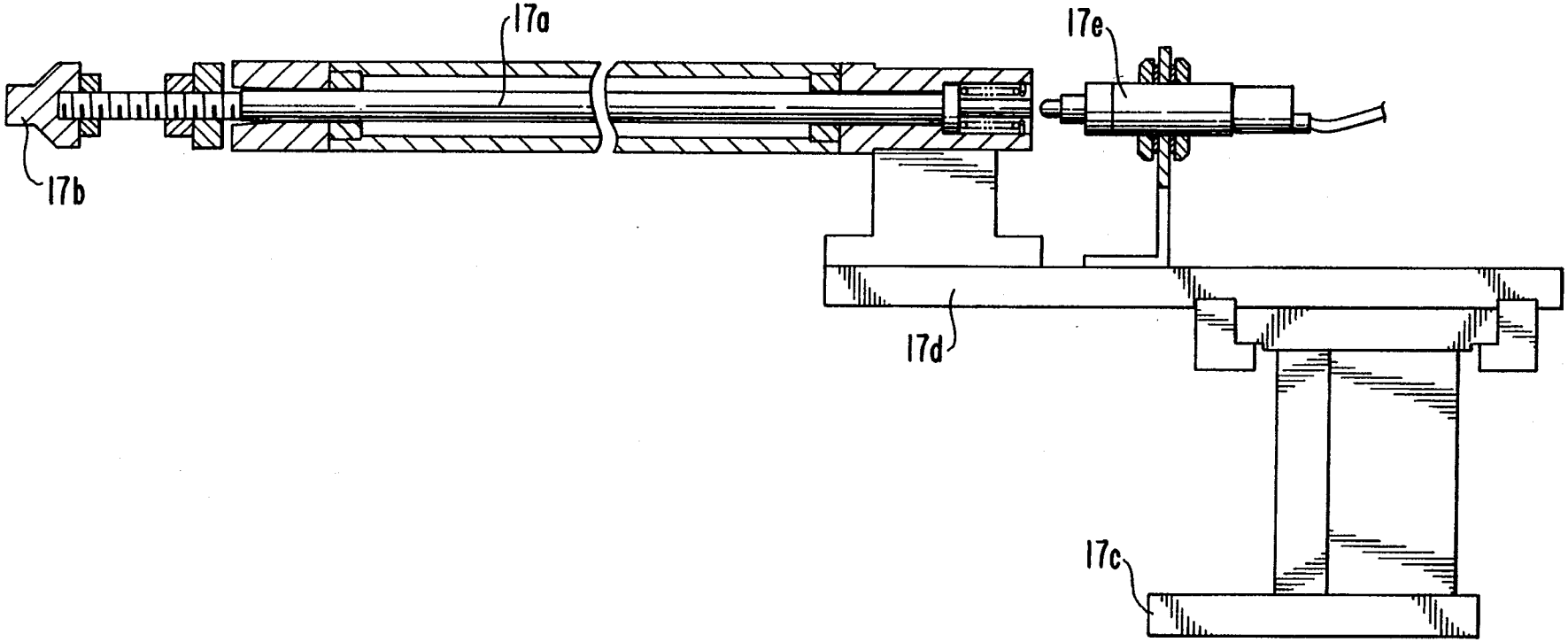

On the other hand, as shown in FIGS. 12 and 13, the above-mentioned back gauge device 17 includes a back gauge 17b threadingly engaged to the tip end of a rod 17a which is supported for free horizontal movement.

The above-mentioned rod 17a has a base end extended toward a movable base 17c to oppose with a touch sensor 17e provided on the movable base 17c for free movement in the lateral direction.

The above-mentioned movable base 17c is supported for free movement in the back and forth direction of the main body 1. The nut member 17f provided on the lower portion is engaged to a ball screw shaft 17h which is driven by a back gauge driving motor 17g to rotate. Therefore, the back gauge 17b can be adjusted the position in the back and forth direction of the main body by the pack gauge driving motor 17g.

On the other hand, in the drawings, the reference numeral 20 denotes a stopper device for positioning the work A introduced by the conveyer 16, in the transporting direction B. The stopper device 20 includes a plurality of, e.g. three stopper cylinders 20a provided in parallel relationship relative to each other in the work transporting direction B.

Figure 14:
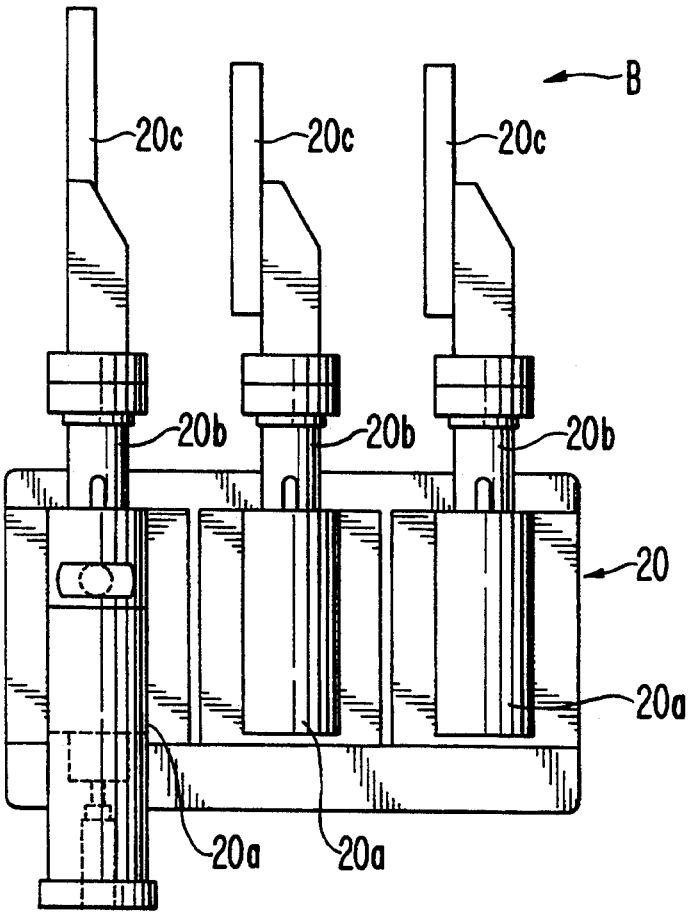
FIG. 14 is an enlarged side elevation showing a stopper device.

Piston rods 20b upwardly extending from these stopper cylinders 20a mount respective stoppers 20c, as shown in FIG. 14 so that in case of the work A with a small width, the stopper 20c at closest position relative to the transporting direction is projected to the position higher than the upper surface of the transporting belt 16e by the stopper cylinder, and in case of the work A with a large width, the stopper 20c at the farthest position relative to the transporting direction is projected by the stopper cylinder 20c for stopping and positioning the work A.

Next, operation will be discussed. The work A to be bent is transported by the conveyer from the direction of the arrow B shown in FIG. 1, and stopped at a working position by one of a plurality of stoppers 20c of the stopper device 20.

Figure 8:
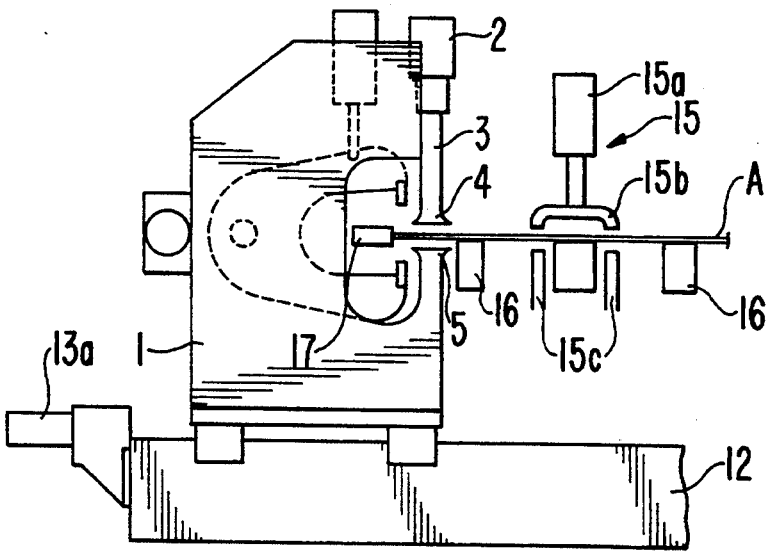

Once the work A is stopped at the working position, a movable clamp 15b of the work clamping device 15 is lowered by a clamping cylinder 15a. Then, the work A is secured between a stationary clamp 15c which is disposed between the transporting belts 16e and the above-mentioned movable clamp 15b (see FIG. 8).

Subsequently, the feed screw shaft 13b of the back and forth driving motor 13a of the back and forth driving device 13 to drive the main body 1 toward the work A. It should be noted when the work A is to be bent at two portions simultaneously, the other main body provided at the opposing position is simultaneously driven toward the work A. When the back gauge 17*b* of the back gauge device 17 comes to contact with the end of the work A for initiating actuation. Then, the main body 1 is stopped at this position. By this, positioning of the bending position is completed.

Once the positioning of the bending position is completed, the vertically movable member 3 is driven downwardly by the work holding cylinder 2 so that the work A is held between the depression die 4 mounted on the vertically movable member 3 and the receiving die 5.

When the work A is to be bent upwardly at this position, the pivotal arm 7 is driven for upward pivotal movement about the support shaft 8 by the vertical bending driving device 9. The end portion of the work A held between the depression die 4 and the receiving die 5 is pushed upwardly by the upward bending die 11 mounted on the pivotal arm 7 for performing upward bending.

Figure 15:
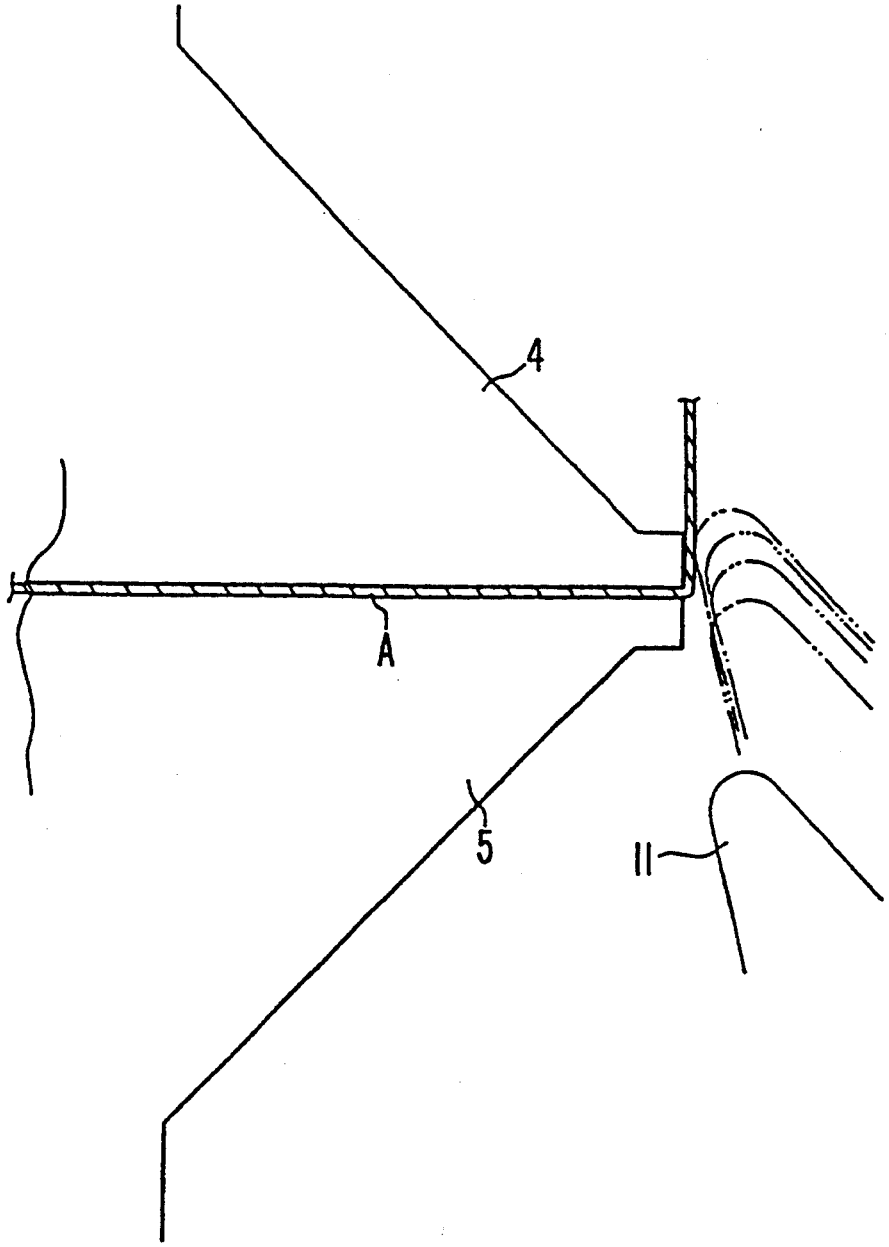
FIG. 15 is an explanatory illustration for showing operation.

It should be noted that FIG. 15 shows the trace of the upward bending die 11 upon upward bending.

On the other hand, at this time, by adjusting the magnitude of upward movement of the pivotal arm 11, the bending angle can be freely adjusted.

As discussed in detail, the present invention provides the bender main bodies in opposition across the conveyer for feeding in the work, and is designed to perform a bending process at a plurality of positions by shifting the bender main bodies toward the work which is transported to and fixed at the working position. Therefore, the present invention can significantly improve the productivity in comparison with the conventional panel bender which performs bending for a plurality of positions by repositioning the work at every time of finishing a bending stroke for one position.

In addition, the width of the conveyer provided between the main bodies can be expanded and contracted according to the movement of the bender main bodies in a toward and an aft direction, interference between the main bodies and the conveyer will never been caused. By this, different width of works can be fed in and out by a single conveyer to provide economical merit.

What is claimed is:

1. A panel bender for bending a work held between a depression die vertically moved by means of a plurality of work holding cylinders fixed in alignment within regular intervals on the upper portion of a main body of the panel bender, and a receiving die provided at the lower portion of the main body and fixed on a bed of the main body, with a downward bending die and an upward bending die provided on a pivotal arm pivoted about a support shaft by a vertical bending driving device provided on said main body for bending said work downwardly and upwardly, wherein a plurality of such main bodies are provided at opposite sides of a conveyer for feeding said work to a working position within the panel bender and aligned to each other in a direction substantially perpendicular to a transporting direction of said conveyer, each of said main bodies being movable in a back and forth direction with respect to the other by a back and forth feeding device, and means for cooperating said main bodies and said conveyer relative to the positions of said main bodies in such a manner that the width of said conveyer disposed between said main bodies is capable of being expanded and contracted in the width direction in synchronism with back and forth movement of the main bodies.

2. A panel bender for bending a work held between a depression die vertically moved by means of a plurality of work holding cylinders fixed in alignment within regular intervals on the upper portion of a main body of the panel bender, and a receiving die provided at the lower portion of the main body and fixed on a bed of the main body, with a downward bending die and an upward bending die provided on a pivotal arm pivoted about a support shaft by a vertical bending driving device provided on said main body for bending said work downwardly, wherein a plurality of such main bodies are provided at opposite positions across a conveyer for feeding said work to a working position within the panel bender, each of said main bodies being movable in a back and forth direction with respect to a machine center by a back and forth feeding device, and means for cooperating each of said main bodies and a corresponding half of said conveyer is provided for adjusting the position of a corresponding lateral edge of said conveyer associating with the positions of said main bodies in such a manner that the width of said corresponding half of said conveyer disposed for each of said main bodies and said machine center is capable of being expanded and contracted in the width direction in cooperation with back and forth movement of the main bodies.

3. A panel bender comprising:

a transporting means defining a transporting path for a work in a plate form extending across a predetermined working position, said transporting means transporting said work into and out from said working position, said transporting means including a first movable component positioned at a first lateral edge of said transporting path for movement toward and away from a center of said transporting path and a second movable component positioned at a second lateral edge of said transporting path for movement toward and away from a center of said transporting path;

a positioning means associated with said transporting means for positioning said work at said working position;

a first bending mechanism provided at one transverse side of said transporting path at the position corresponding to said working position, said first bending mechanism being movable toward said working position in a first stroke determined depending upon the transverse width of said work and a desired width of a first edge portion of the work to be bent;

a second bending mechanism provided at one transverse side of said transporting path at the position corresponding to said working position, said second bending mechanism being movable toward said working position in a second stroke determined depending upon the transverse width of said work and a desired width of a second edge portion of the work to be bent;

first cooperating means for cooperating said first bending mechanism with said first movable component of said transporting means so that said first bending mechanism and said first movable component are moved relative toward and away from the center of said transporting path in unison; and said cooperating means for cooperating said second bending mechanism with said second movable component of said transporting means so that said second bending mechanism and said second movable component are moved relative toward and away from the center of said transporting path in unison.

4. A panel bender as set forth in claim 3, wherein said transporting means includes means for adjusting a transverse width of said transporting path relative to the transverse position of at least a respective one of said first and second bending mechanisms.

5. A panel bender as set forth in claim 4, wherein said transporting means includes a first path means defining a first half of said transporting path positioned adjacent said first bending mechanism and a second path means defining a second half of said transporting path positioned adjacent said second bending mechanism, said first path means and said second path means each having a variable transverse width depending upon the relative positions to a respectively corresponding one of said first and second bending mechanisms.

6. A panel bender as set forth in claim 5, wherein said transporting means further includes means for defining a fixed reference line extending in a transporting direction and transversely positioned between said first path means and said second path means so that shifting outer edges of said first path means and said second path means toward and away from said reference line adjust the transverse widths of said first and second halves of said transporting path.

7. A panel bender comprising:

a transporting means defining a transporting path for a work in a plate form extending across a predetermined working position, said transporting means transporting said work into and out from said working position, said transporting means including a first movable component positioned at a first lateral edge of said transporting path for movement toward and away from a center of said transporting path and a second movable component positioned at a second lateral edge of said transporting path for movement toward and away from a center of said transporting path;

a positioning means associated with said transporting means for positioning said work at said working position;

a first bending mechanism provided at one transverse side of said transporting path at the position corresponding to said working position, said first bending mechanism being movable toward said working position in a first stroke determined depending upon the transverse width of said work and a desired width of a first edge portion of the work to be bent;

a second bending mechanism provided at one transverse side of said transporting path at the position corresponding to said working position, said second bending mechanism being movable toward said working position in a second stroke determined depending upon the transverse width of said work and a desired width of a second edge portion of the work to be bent;

first cooperating means for mechanically connecting said first bending mechanism with said first movable component of said transporting means so that said first bending mechanism and said first movable component are moved relatively toward and away from the center of said transporting path in unison; and second cooperating means for mechanically connecting said second bending mechanism with said second movable component of said transporting means so that said second bending mechanism and said second movable component are moved relatively toward and away from the center of said transporting path in unison.

8. A panel bender as set forth in claim 7, wherein said transporting means includes a first path means defining a first half of said transporting path positioned adjacent said first bending mechanism and a second path means defining a second half of said transporting path positioned adjacent said second bending mechanism, said first path means and said second path means each having a variable transverse width depending upon the relative positions to a respectively corresponding one of said first and second bending mechanisms.

9. A panel bender as set forth in claim 8, wherein said transporting means further includes means for defining a fixed reference line extending in a transporting direction and transversely positioned between said first and second path means so that outer edges of said first and second path means are shifted toward and away from said reference line for adjusting the transverse widths of said first and second halves of said transporting path.

10. A panel bender for bending lateral edges of a panel form work transported along a transporting path defined by means of a conveyer system having a lateral dimension, comprising:

means for stopping and holding said work at a working position;

at first bending unit located at one side of said transporting path and movable relative to said working position for bending a first side lateral edge of said work into a predetermined first configuration;

a second bending unit located at the other side of said transporting path and movable relative to said work position for bending a second side lateral edge of said work into a predetermined second configuration; and means for cooperating said conveyer system with said first and second bending units in order to vary said lateral dimension of said conveyer system in synchronism with movement of said first and second bending units.

11. A panel bender for bending lateral edges of a panel form work comprising:

a conveyer system for transporting said work along a transporting path, said conveyer system including a plurality of separated components movable in a lateral direction;

means for stopping and holding said work at a working position;

a first bending unit located at one side of said transporting path and movable relative to said working position for bending a first side lateral edge of said work into a predetermined first configuration;

a second bending unit located at the other side of said transporting path and movable relative to said work position for bending a second side lateral edge of said work into a predetermined second configuration; and means for causing lateral shifting of said components of said conveyer system depending upon lateral strokes of said first and second bending units in order to vary the overall lateral dimension of said conveyer system for avoiding interference between said first and second bending units and said conveyer system.

* * * * *